US010420421B2

(12) United States Patent
Kim et al.

(10) Patent No.: US 10,420,421 B2
(45) Date of Patent: Sep. 24, 2019

(54) SLIDE UNIT FOR DRAWER

(71) Applicant: SEGOS CO., LTD., Incheon (KR)

(72) Inventors: Duc Hoi Kim, Incheon (KR); Sung Woo Kim, Seoul (KR); In Suk Ra, Gyeonggi-do (KR); Jung Kyu Lim, Incheon (KR)

(73) Assignee: SEGOS CO., LTD., Incheon (KR)

( * ) Notice: Subject to any disclaimer, the term of this patent is extended or adjusted under 35 U.S.C. 154(b) by 0 days.

(21) Appl. No.: 15/564,621

(22) PCT Filed: Apr. 14, 2016

(86) PCT No.: PCT/KR2016/003901
§ 371 (c)(1),
(2) Date: Oct. 5, 2017

(87) PCT Pub. No.: WO2016/167576
PCT Pub. Date: Oct. 20, 2016

(65) Prior Publication Data

US 2018/0084911 A1 Mar. 29, 2018

(30) Foreign Application Priority Data

Apr. 13, 2015 (KR) ..... 10-2015-0051559
Apr. 14, 2016 (KR) ..... 10-2016-0045546

(51) Int. Cl.
*A47B 88/40* (2017.01)
*A47B 88/493* (2017.01)
(Continued)

(52) U.S. Cl.
CPC ..... *A47B 88/493* (2017.01); *A47B 88/40* (2017.01); *A47B 88/443* (2017.01); *A47B 88/447* (2017.01);
(Continued)

(58) Field of Classification Search
CPC ..... A47B 88/493; A47B 88/40; A47B 2210/0032; A47B 2210/0035;
(Continued)

(56) References Cited

U.S. PATENT DOCUMENTS 4,465,324 A * 8/1984 Rock ..... A47B 88/487 312/334.39
4,752,142 A * 6/1988 Jackson ..... A47B 88/487 384/18
(Continued)

FOREIGN PATENT DOCUMENTS

CN 102512005 A 6/2012
CN 103747705 A 4/2014
(Continued)

OTHER PUBLICATIONS

International Search Report for PCT/KR2016/003901.
(Continued)

*Primary Examiner* — Janet M Wilkens
(74) *Attorney, Agent, or Firm* — The PL Law Group, PLLC

(57) ABSTRACT

A slide unit for a drawer includes a middle slide rail molded through a simple process to enhance productivity. The middle slide rail of the slide unit has an improved structure to enable each of a main body-side fixed rail and a drawer-side fixed rail to more smoothly slide on the middle slide rail.

23 Claims, 15 Drawing Sheets

(51) Int. Cl.
*A47B 88/443* (2017.01)
*A47B 88/447* (2017.01)

(52) U.S. Cl.
CPC ..... *A47B 2210/0032* (2013.01); *A47B 2210/0035* (2013.01); *A47B 2210/0037* (2013.01); *A47B 2210/0056* (2013.01); *A47B 2210/0059* (2013.01)

(58) Field of Classification Search
CPC .... A47B 2210/0037; A47B 2210/0056; A47B 2210/0059
USPC ... 312/334.11, 334.13, 334.37, 334.1, 334.6, 312/334.15, 334.33, 334.38, 334.26, 312/334.25, 334.9
See application file for complete search history.

(56) References Cited

U.S. PATENT DOCUMENTS 4,921,359 A 5/1990 Sakamoto
5,570,943 A * 11/1996 Schroder ..... A47B 88/493 312/334.11
6,132,020 A * 10/2000 Schael ..... A47B 88/493 312/334.1
8,414,094 B2 * 4/2013 Chi ..... A47B 88/493 312/333
8,646,856 B2 * 2/2014 Park ..... A47B 88/493 312/334.1
2004/0000851 A1 1/2004 Lam Harn et al.
2006/0273705 A1 * 12/2006 Yeh ..... A47B 88/493 312/334.31
2011/0241515 A1 * 10/2011 Park ..... A47B 88/10 312/408
2011/0309732 A1 * 12/2011 Horil ..... A47B 88/10 312/404
2014/0009053 A1 * 1/2014 Chung ..... A47B 88/0466 312/334.18
2016/0167098 A1 * 6/2016 Weng ..... B21D 5/08 72/379.2

FOREIGN PATENT DOCUMENTS

DE 29507916 * 8/1995
DE 19511999 * 10/1996
DE 29807536 * 7/1998
DE 202 10 102 U1 10/2002
DE 102012106751 * 1/2014
DE 202014105949 * 2/2015
EP 0541306 A1 5/1993
JP 2002-017486 A 1/2002
JP 2009-112409 A 5/2009
KR 20-2010-0007083 U 7/2010
KR 10-2011-0087304 A 8/2011
KR 10-1114486 B1 2/2012
KR 10-1398127 B1 5/2014
WO WO2008-038472 A1 4/2008
WO 2010013924 * 2/2010

OTHER PUBLICATIONS

Office action dated May 23, 2017 from Korean Patent Office in a counterpart Korean Patent Application No. 10-2016-0045546.
European Search Report for EP16780299.0 dated Sep. 14, 2018 from European patent office in a cunterpart European patent application.
Office action dated Jan. 21, 2019 from China Patent Office in a counterpart China Patent Application No. 201680019806.2 (English translation is also submitted herewith.).

* cited by examiner

SLIDE UNIT FOR DRAWER

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2016/003901, filed Apr. 14, 2016, which claims priority to the benefit of Korean Patent Application No. 10-2015-0051559 filed on Apr. 13, 2015 and 10-2016-0045546 filed on Apr. 14, 2016 in the Korean Intellectual Property Office, the entire contents of which are incorporated herein by reference.

TECHNICAL FIELD

The present invention relates generally to a slide unit for a drawer. More particularly, the present invention relates to a slide unit for a drawer, the slide unit configured such that an inner rail is manufactured through a simple process to improve productivity, and the structure of the inner rail is improved not only to allow a movable rail to smoothly slide relative to the inner rail but also to allow the inner rail to smoothly slide relative to a fixed rail.

BACKGROUND ART

In general, a drawer guide rail member is provided between a main body and a drawer so that when a user opens and closes the drawer, the drawer is easily pulled out from and pushed into the main body.

The drawer guide rail members are, for example, a two-stage folding type and a three-stage folding type. In the case of the three-fold folding type, a main body-side fixed rail is fixed to an inner surface of a refrigerator inner wall or general furniture, and a side fixed rail is fixed to a drawer body (drawer). Further, the drawer guide rail member is configured such that a middle slide rail is disposed between the main body-side fixed rail and the drawer-side fixed rail, and a plurality of slide balls is disposed between the main body-side fixed rail and the middle slide rail, and between the drawer-side fixed rail and the middle slide rail.

However, conventionally, since the middle slide rail is formed by a complicated roll forming process, there is a problem that the manufacturing cost is increased and the productivity is decreased. Further, there is a possibility of corrosion due to the inability to perform plating on the side surface portion, and thus the durability is deteriorated.

Accordingly, the inventor proposes a structure configured such that a middle slide rail is formed through a more simple process than the conventional process to improve productivity, and the structure of the middle slide rail is improved to allow a main body-side fixed rail and a drawer-side fixed rail to smoothly slide relative to the middle slide rail.

SUMMARY

Accordingly, the present invention has been made keeping in mind the above problems occurring in the related art, and an object of the present invention is to provide a slide unit for a drawer, the slide unit configured such that a middle slide rail is formed through a simple process to improve productivity, and the structure of the middle slide rail is improved to allow a main body-side fixed rail and a drawer-side fixed rail to smoothly slide relative to the middle slide rail.

In order to achieve the above object, the present invention provides a slide unit for a drawer, the slide unit including: a fixed rail fixed to a main body and provided with an inner accommodation space at a side thereof; a movable rail configured to be movable relative to the fixed rail while being connected to a drawer body to allow the drawer body to be pulled out from and pushed into the main body, and provided with an inner accommodation space; and an inner rail configured such that at least a portion thereof is provided in the inner accommodation spaces of both the fixed rail and the movable rail to allow the movable rail to slide relative to the fixed rail, wherein the inner rail is formed by rolling.

In order to achieve the above object, the present invention further provides slide unit for a drawer, the slide unit including: a fixed rail fixed to a main body; a movable rail configured to be movable relative to the fixed rail while being connected to the drawer body to allow the drawer body to be pulled out from and pushed into the main body, and provided with an inner accommodation space; and an inner rail connected to an end portion of the fixed rail to be disposed in the inner accommodation space of the movable rail, and configured to allow the movable rail to slide relative to the fixed rail, wherein the inner rail is formed by rolling.

In order to achieve the above object, the present invention further provides a slide unit for a drawer, the slide unit configured such that the inner rail includes: a plate; and a contact portion integrally connected to each of opposite ends of the plate, and configured to come into contact with a plurality of slide balls accommodated in the inner accommodation spaces of both the fixed rail and the movable rail, wherein the contact portion is provided with three rolling surfaces to be spaced apart from each other along a circumferential direction thereof, and the rolling surfaces include: a pair of first rolling surfaces 334 curvedly provided at opposite sides of an upper portion of the contact portion with a pair of first slide balls 351 seated thereon; and a second rolling surface 335 having a diameter larger than a diameter of each of the first rolling surfaces 334, and being provided to be curved in a direction toward the drawer body 20 under the first rolling surfaces 334 with a second slide ball 352 rolling thereon.

According to the slide unit for a drawer of the present invention, since the inner rail allowing the movable rail to slide relative to the fixed rail is formed by rolling, it is possible to lower manufacturing cost and to improve productivity through simplifying processes.

Further, it is possible to uniformly coat the plating solution on the surface of the entire inner rail, thereby further preventing corrosion and increasing durability.

Further, since the plate of the inner rail is provided with a plurality of reinforcing ribs that extend along a longitudinal direction of the plate and are spaced apart from each other along a width direction of the plate, it is possible to prevent deformation by reinforcing the strength of the inner rail.

Further, since the contact portion includes at least one groove provided in each of the plurality of rolling surfaces spaced apart from each other, or includes at least one rolling protrusion provided in each of the plurality of rolling surfaces spaced apart from each other, it is possible to reduce the mutual rolling contact area between a plurality of slide balls and the inner rail, thereby not only allowing the movable rail to further smoothly slide relative to the inner rail, but also allowing the inner rail to smoothly slide relative to the fixed rail.

Further, since the slide balls allowing slide movement have different diameters, the durability of the inner rail is further improved, and rollability is improved, even when a heavy load is applied to the slide unit when the drawer body contains a heavy object.

BRIEF DESCRIPTION OF THE DRAWING

FIGS. 18A to 18C show a modification of the inner rail according to the present invention, wherein FIG. 18A is a perspective view showing one modification of the inner rail described in FIG. 12, and FIGS. 18B and 18C are perspective views showing another modification of the inner rail described in FIG. 2;

DETAILED DESCRIPTION

Figure 1:
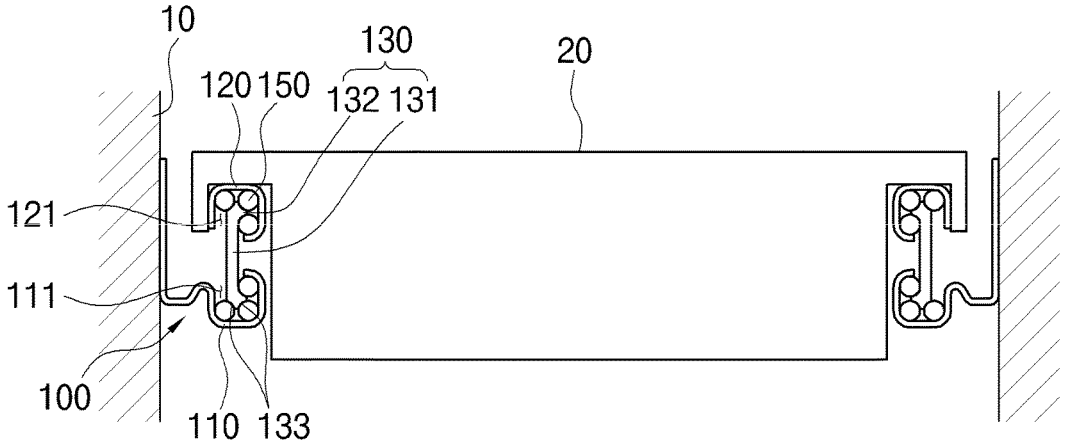
FIG. 1 is a view showing a state where a slide unit for a drawer according to a first embodiment of the present invention is installed.

Hereinbelow, to aid in understanding the invention, preferred embodiments of the present invention will be described in detail with reference to the accompanying drawings. It should be understood that the embodiment of the present invention may be changed to a variety of embodiments and the scope and spirit of the present invention are not limited to the embodiment described hereinbelow. The embodiment of the present invention described hereinbelow is provided for allowing those skilled in the art to more clearly comprehend the present invention. Therefore, it should be understood that the shape and size of the elements shown in the drawings may be exaggeratedly drawn to provide an easily understood description of the structure of the present invention. Wherever possible, the same reference numerals will be used throughout the drawings and the description to refer to the same or like elements or parts. In the following description, it is to be noted that, when the functions of conventional elements and the detailed description of elements related with the present invention may make the gist of the present invention unclear, a detailed description of those elements will be omitted.

A slide unit for a drawer (hereinafter, referred to as 'slide unit') according to a preferred embodiment of the present invention is provided to allow drawers of electronic devices, specifically drawer refrigerators or various furniture, to be movable forward and backward.

Figure 2:
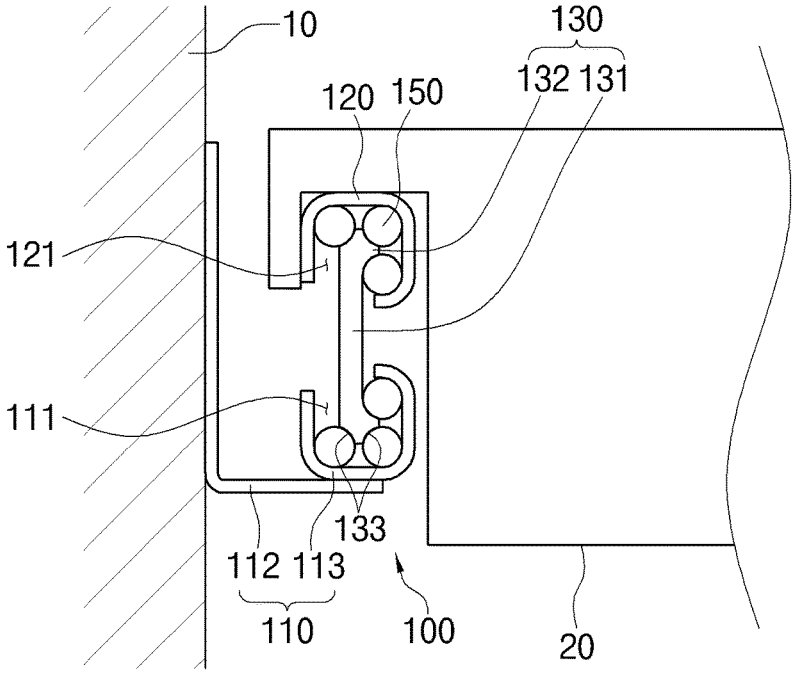
FIG. 2 is a view showing a state where another example of a fixed rail is applied to FIG. 1.
Figure 3:
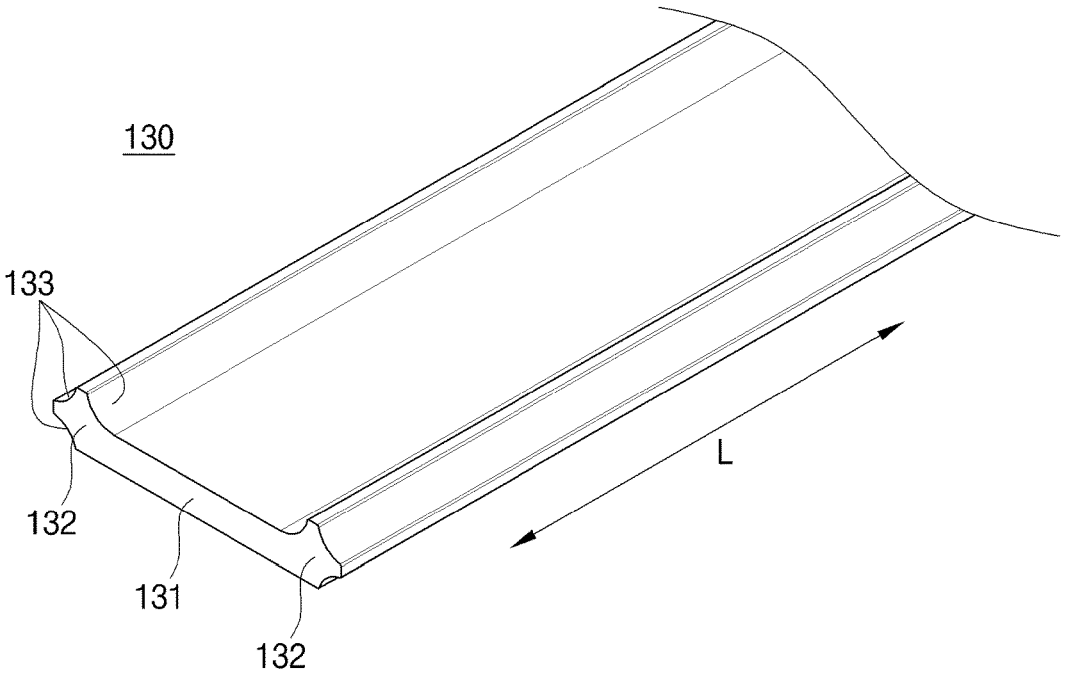
FIG. 3 is a perspective view showing an inner rail of the slide unit for a drawer according to the first embodiment of the present invention.
Figure 4:
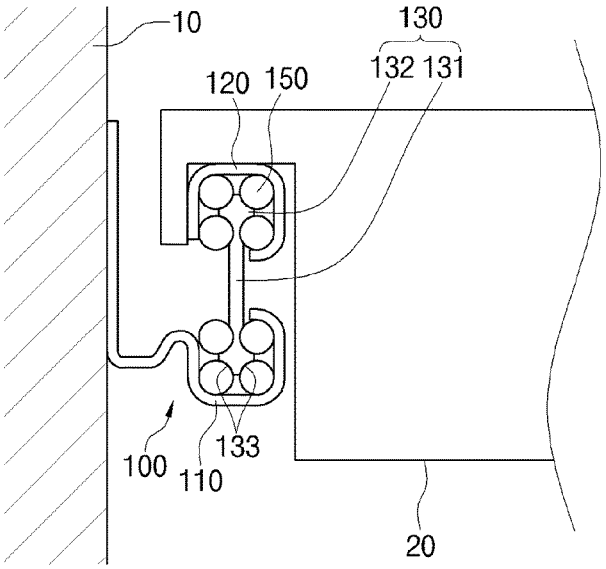
FIG. 4 is a view showing another example of FIG. 1.

FIG. 1 is a view showing a state where a slide unit for a drawer according to a first embodiment of the present invention is installed; FIG. 2 is a view showing a state where another example of a fixed rail is applied to FIG. 1; FIG. 3 is a perspective view showing an inner rail of the slide unit for a drawer according to the first embodiment of the present invention; and FIG. 4 is a view showing another example of FIG. 1.

Hereinafter, the present invention will be described with reference to various embodiments.

As shown in FIG. 1, a slide unit 100 according to the first embodiment of the present invention includes: a fixed rail 110 fixed to a main body 10 and provided with an inner accommodation space 111 at a side thereof; a movable rail 120 configured to be movable relative to the fixed rail 110 while being connected to a drawer body 20 to allow the drawer body to be pulled out from and pushed into the main body 10, and provided with an inner accommodation space 121; and an inner rail 130 configured such that at least a portion thereof is provided in the inner accommodation spaces 111 and 121 of both the fixed rail 110 and the movable rail 120 to allow the movable rail to slide relative to the fixed rail 110.

Firstly, the fixed rail 110 can be fixed to various parts such as an inner wall surface of a refrigerator or furniture by using screws or the like. Hereinafter, reference will be made to the case of being provided in a refrigerator, for convenience of explanation.

To be more specific, as shown in FIG. 1, the fixed rail 110 may be configured to be fixed to the inner wall surface of a refrigerator and be approximately doubly curved 'U' shaped with an accommodation space 111 integrally connected thereto. The fixed rail 110 may be formed by, for example, a pressing forming process.

However, not limited thereto, as shown in FIG. 2, the fixed rail 110 may include: a fixed frame 112 fixed to the main body 10; and an auxiliary frame 113 fixed to the fixed frame 112 and provided with an inner accommodation space 111 at a side thereof. Here, the fixed frame 112 and the auxiliary frame 113 may be fixedly coupled to each other through, for one example, spot welding, rivet joint, screw-coupling, and the like.

As described above, the fixed rail 110 may be configured as the former or the latter configurations, wherein in the latter case, the number of components is reduced and no mutual bonding process is required, so considering the manufacturing cost reduction and the productivity improvement, it is more preferable to be applied to the former case. Hereinafter, reference will be made on the basis of the case where the fixed rail 110 is applied as the former structure when the related component is described.

Next, the movable rail 120 is movable relative to the fixed rail 110 while being connected to the drawer body 20 to allow the drawer body 20, specifically a drawer of a drawer refrigerator, to be pulled out from and pushed into the main body 10, and provided with an inner accommodation space 121. The movable rail 120 may be fixedly coupled to the drawer body 20 by using a separate bracket (not shown), etc.

Next, the inner rail 130 is configured such that at least a portion thereof is provided in the inner accommodation spaces 111 and 121 of both the fixed rail 110 and the movable rail 120 to allow the movable rail 120 to slide relative to the fixed rail 110.

In the embodiment of the present invention, the inner rail 130 is formed by rolling. Rolling means a method of processing a metal material having a high temperature or a room temperature using plasticity of the metal by passing the material through a rotating roller.

Meanwhile, a conventional rail corresponding to the inner rail 130 of the present is formed by roll forming. To be more specific, one plate is formed by rolling to form a contact surface with a plurality of slide balls, and opposite sides thereof are bent such that a center portion thereof has two layers.

However, the above described conventional inner rail formed by roll forming is problematic in that since the opposite end portions disposed at the center do not completely contact each other, it is difficult for the plating solution to be injected into a fine clearance where the two layers contact each other. Thereby, the possibility of corrosion is increased at the portion where the plating solution is not coated, and as time passes, the corroded portion expands to the entire region and the durability of the entire inner rail drops sharply.

Unlike the conventional inner rail, in the present invention, since the inner rail 130 is formed by rolling, and no separate bending process is required, it possible to lower manufacturing cost and to improve productivity through simplifying processes. Further, since there is no fine clearance where the two layers contact each other, which conventionally exists, it is possible to uniformly coat the plating solution on the surface of the entire inner rail 130, thereby further preventing corrosion and increasing durability.

As shown in FIGS. 1 and 3, the inner rail 130 includes: a plate 131 provided at outer areas of both the fixed rail 110 and the movable rail 120; and a contact portion 132 integrally connected to each of opposite ends of the plate 131 and configured to come into rolling contact with each of a plurality of slide balls 150 accommodated in the inner accommodation spaces 111 and 121.

In the embodiment of the present invention, for one example, as shown in FIGS. 1 and 3, the contact portion 132 is provided with three rolling surfaces 133 spaced apart from each other along a circumferential direction thereof, and the rolling surfaces 133 extend along a longitudinal direction L of the contact portion 132. In other words, based on cross sections of the fixed rail 110 and the movable rail 120, three slide balls 150 are provided in the inner accommodation spaces 111 and 121 of the fixed rail 110 and the movable rail 120, respectively, and the inner rail 130 comes into rolling contact with the slide balls 150 to allow reciprocating slide motion of the movable rail 120. Herein, the circumferential direction of the contact portion 132 means a circumferential direction of the edge of the contact portion 132, based on the cross section of the inner rail 130. Meanwhile, when the three slide balls 150 are defined as a group, the group of three slide balls 150 may be provided in plural in the inner accommodation spaces 111 and 121 of the fixed rail 110 and the movable rail 120 along a longitudinal direction thereof.

For another example, as shown in FIG. 4, the contact portion 132 may be provided with four rolling surfaces 133 spaced apart from each other along the circumferential direction thereof, and the rolling surfaces 133 may extend along the longitudinal direction of the contact portion 132. In other words, based on the cross sections of the fixed rail 110 and the movable rail 120, four slide balls 150 are provided in the inner accommodation spaces 111 and 121 of the fixed rail 110 and the movable rail 120, respectively, and the inner rail 130 comes into rolling contact with the slide balls 150 to allow reciprocating slide motion of the movable rail 120. Meanwhile, each of the fixed rail 110 and the movable rail 120 is provided with a separate stopper (not shown) that is capable of preventing the plurality of slide balls 150 from being separated and limiting a sliding distance of the inner rail 130 relative to the fixed rail 110 and a sliding distance of the movable rail 120 relative to the inner rail 130.

Hereinafter, reference will be made to the case where three rolling surfaces 133 are provided on the contact portion 132, for convenience of explanation.

Figure 5:
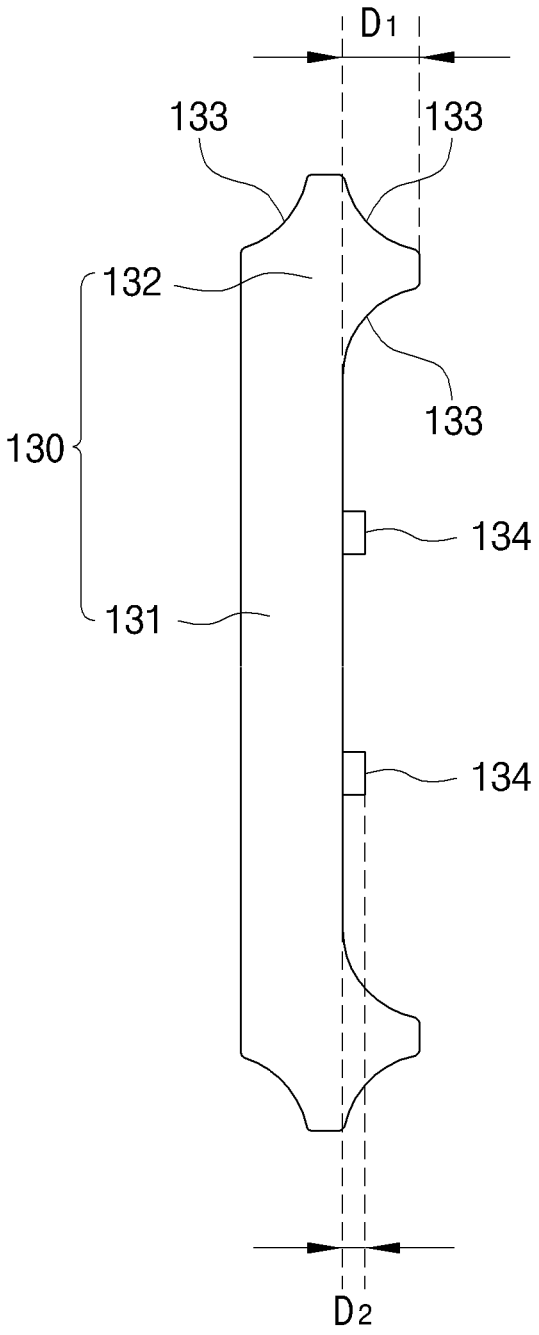
FIG. 5 is a view showing a state where a reinforcing rib is provided in the inner rail of the slide unit for a drawer according to the first embodiment of the present invention.
Figure 6:
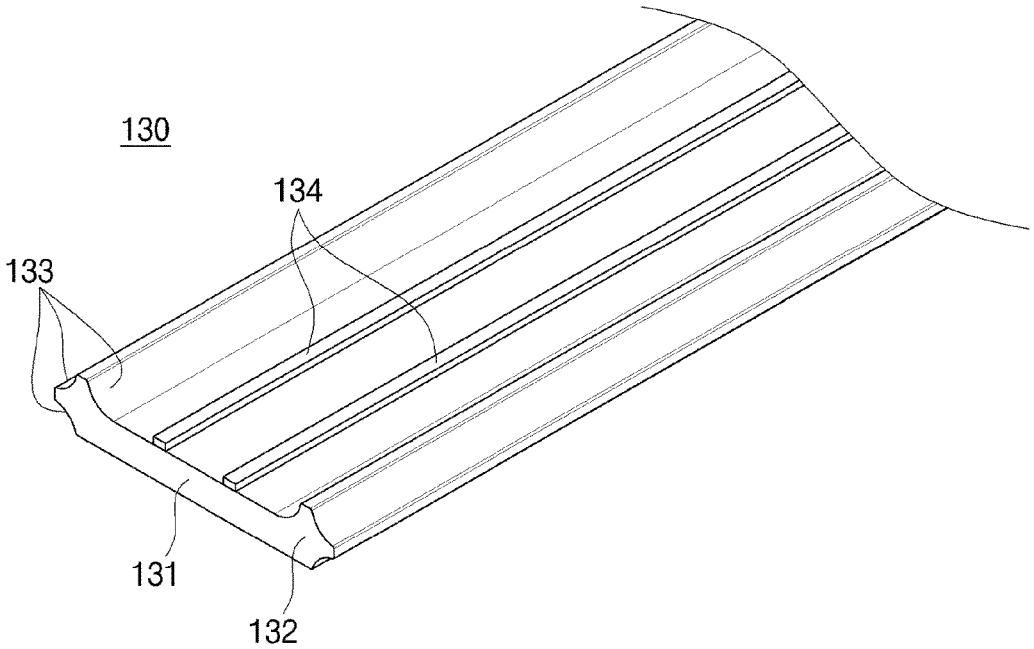
FIG. 6 is a perspective view showing a state where the reinforcing rib is provided in the inner rail of the slide unit for a drawer according to the first embodiment of the present invention.
Figure 7:
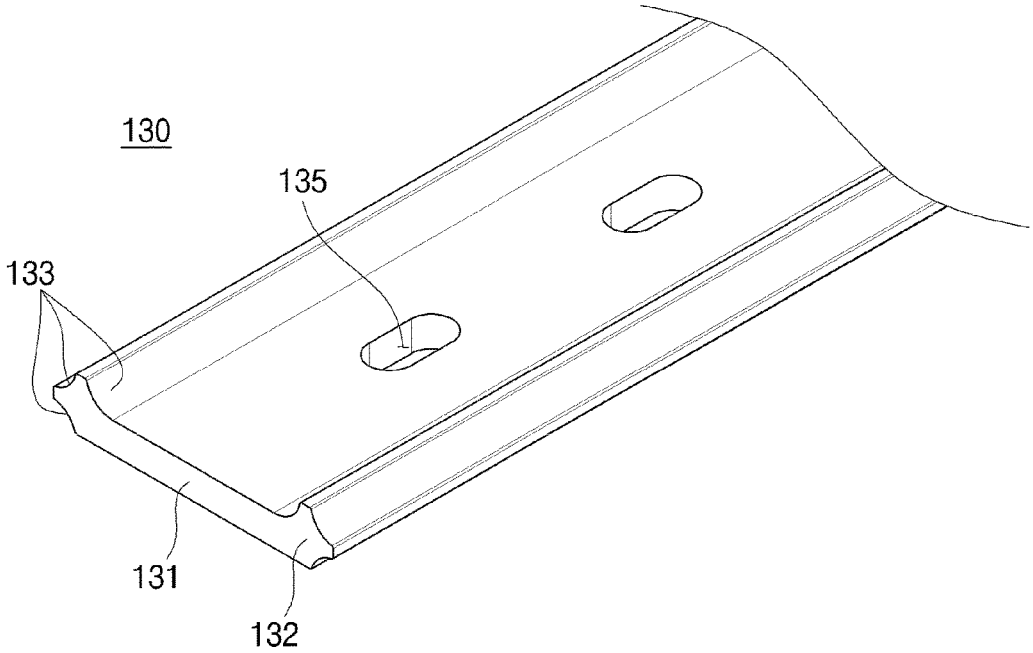
FIG. 7 is a perspective view showing a state where through-holes are provided in the inner rail of the slide unit for a drawer according to the first embodiment of the present invention.

FIG. 5 is a view showing a state where a reinforcing rib is provided in the inner rail of the slide unit for a drawer according to the first embodiment of the present invention; FIG. 6 is a perspective view showing a state where the reinforcing rib is provided in the inner rail of the slide unit for a drawer according to the first embodiment of the present invention; and FIG. 7 is a perspective view showing a state where through-holes are provided in the inner rail of the slide unit for a drawer according to the first embodiment of the present invention.

In the present invention, as shown in FIGS. 5 and 6, the plate 131 may be provided with a plurality of protruding reinforcing ribs 134 that extend along a longitudinal direction of the plate and are spaced apart from each other along a width direction of the plate.

The plurality of reinforcing ribs 134 prevent the inner rail 130 from being deformed (such as bending) when the load of the drawer body 20 is exerted on both the movable rail 120 and the inner rail 130, particularly when the considerable load of the object stored in the drawer body 20 is transmitted to the inner rail 130. For reference, when the inner rail 130 is deformed by the load of the drawer body 20, the smooth slide movement of the drawer body 20 is restricted.

Herein, it is preferred that a protruding height D2 of each of the reinforcing ribs 134 be smaller than a vertical distance D1 between the surface of the plate 131 with the plurality of reinforcing ribs being connected thereto and an end portion of the contact portion 132 adjacent to the corresponding reinforcing rib.

If the protruding height D2 of the reinforcing ribs 134 is formed to be greater than a certain length, the interference between the reinforcing ribs 134 and the local areas of both the movable rail 120 and the fixed rail 110 may occur, and the self-weight of the inner rail 130 also increases.

The present invention is configured such that the protruding height of the reinforcing ribs 134 is formed within a range above described, whereby it is possible to maximally prevent interference with the reinforcing ribs 134 when the movable rail 120 slides, and also it is possible to further prevent the deformation of the inner rail 130 caused by the load of the drawer body 20 by reinforcing the strength of the plate 131.

As shown in FIG. 7, in the present invention, the plate 131 may be provided with a plurality of through-holes 135 spaced apart from each other along a longitudinal direction thereof. The through-holes 135 may be formed by a punching process of the press process, for example. In this case, the self-weight of the inner rail 130 can be reduced, and thus, it is possible to reduce the weight of the entire product.

Figure 8:
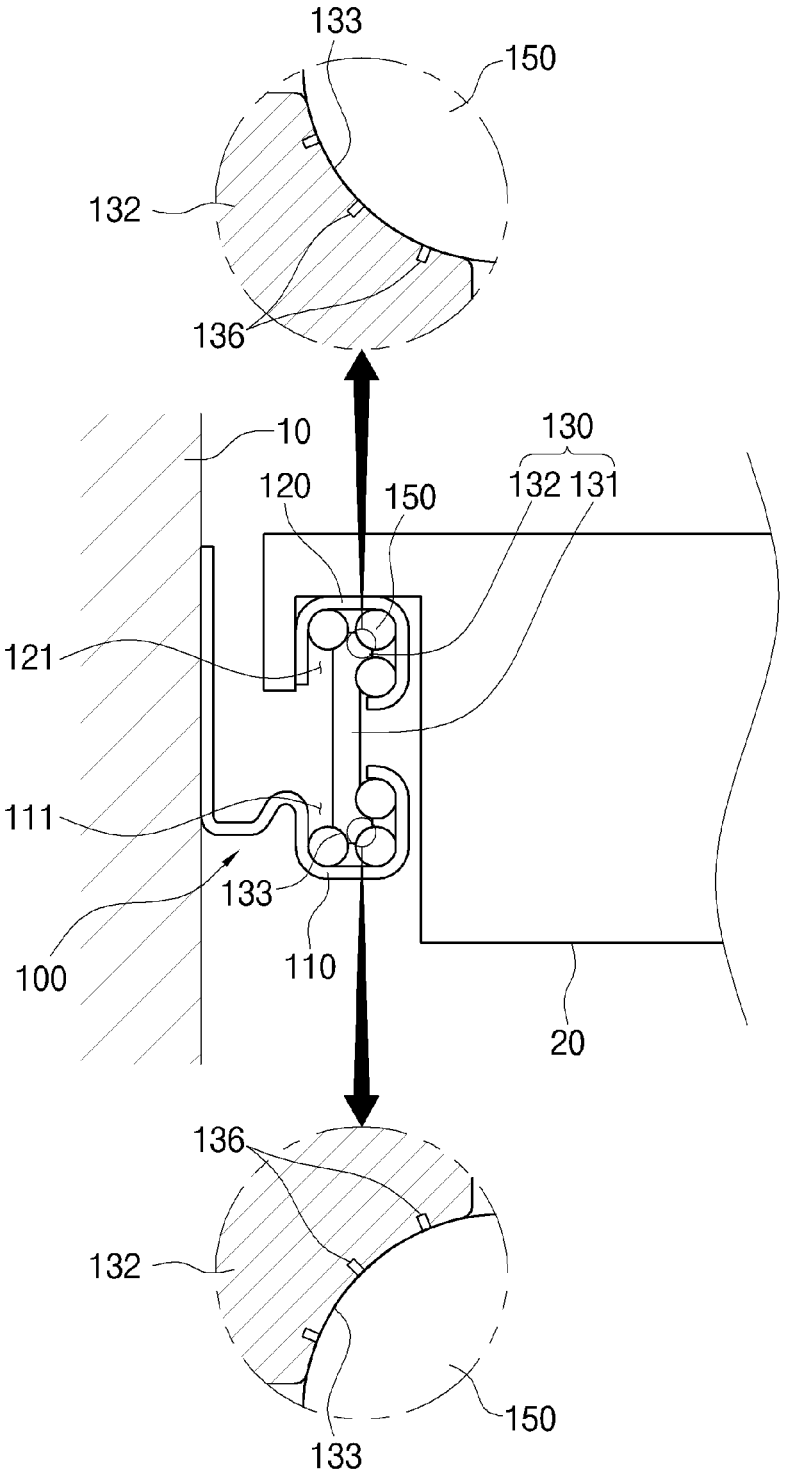
FIG. 8 is a view showing a state where a rolling surface of a contact portion is provided with a plurality of grooves, in the slide unit for a drawer according to the first embodiment of the present invention.
Figure 9:
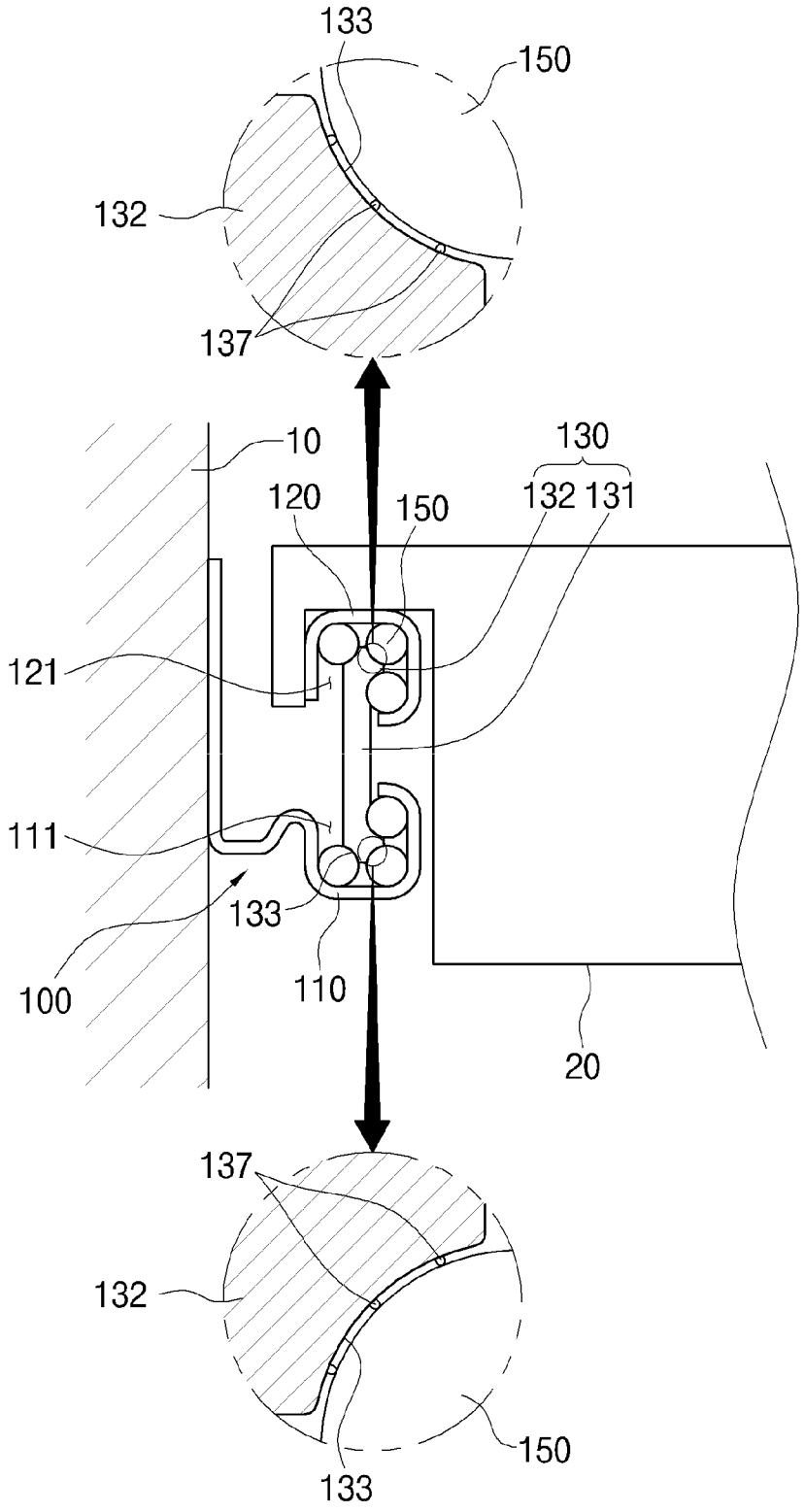
FIG. 9 is a view showing a state where the rolling surface of the contact portion is provided with a plurality of rolling protrusions, in the slide unit for a drawer according to the first embodiment of the present invention.

FIG. 8 is a view showing a state where a rolling surface of a contact portion is provided with a plurality of grooves, in the slide unit for a drawer according to the first embodiment of the present invention; and FIG. 9 is a view showing a state where the rolling surface of the contact portion is provided with a plurality of rolling protrusions, in the slide unit for a drawer according to the first embodiment of the present invention.

Hereinafter, reference will be made to a structure that allows movable rail 120 to smoothly slide relative to the fixed rail 110.

To achieve this, for one example, as shown in FIG. 8, the contact portion 132 includes at least one groove 136 provided in each of the plurality of rolling surfaces 133 spaced apart from each other. The groove 136 extends along a longitudinal direction of the plate 131, and a plurality of grooves 136 may be formed simultaneously when the inner rail 130 is formed by rolling. Further, the plurality of grooves 136 may be formed through a separate grooving process. Further, the plurality of grooves 136 may be continuously formed from a longitudinal first end to a longitudinal second end of the plate 131. In the related drawing, the groove 136 is formed in some of the rolling surfaces 133, which is for convenience of illustration. In practice, the groove 136 is formed in all of the rolling surfaces 133.

In the present invention, since each of the rolling surfaces 133 of the contact portion 132 is provided with at least one groove 136, it is possible to reduce the mutual contact area between the rolling surfaces 133 of the contact portion 132 and the plurality of slide balls 150 compared to the case where the groove 136 is not provided. For reference, when viewed from the cross section, the mutual contact area between the rolling surfaces 133 of the contact portion 132 and the plurality of slide balls 150 can be reduced by the width of the at least one groove 136. Accordingly, the present invention further reduces the mutual contact area between the rolling surfaces 133 of the contact portion 132 and the plurality of slide balls 150, such that a frictional force occurring between the plurality of slide balls 150 and the rolling surfaces 133 when the movable rail 120 slides relative to the inner rail 130 and the inner rail 130 slides relative to the fixed rail 110 is reduced, thereby allowing the movable rail 120 to smoothly slide.

For another example, as shown in FIG. 9, the contact portion 132 includes at least one rolling protrusion 137 that protrudes from each of the plurality of rolling surfaces 133 and is spaced apart from each other. The rolling protrusion 137 extends along a longitudinal direction of the plate 131, and a plurality of rolling protrusions 137 may be formed simultaneously when the inner rail 130 is formed by rolling. Further, the plurality of rolling protrusions 137 may be provided on the rolling surfaces 133 by wielding after being separately formed. Further, the plurality of rolling protrusions 137 may be continuously formed from the longitudinal first end to the longitudinal second end of the plate 131. In the related drawing, the rolling protrusion 137 is formed in some of the rolling surfaces 133, which is for convenience of illustration, and thus, the rolling protrusion 137 is formed in all of the rolling surfaces 133.

In the present invention, since each of the rolling surfaces 133 of the contact portion 132 is provided with at least one rolling protrusion 137, it is possible to reduce the mutual contact area between the rolling surfaces 133 of the contact portion 132 and the plurality of slide balls 150 compared to the case where the rolling protrusion 137 is not provided. For reference, when viewed from the cross section, the plurality of slide balls 150 come into contact with outer surfaces of the plurality of rolling protrusion 137 without coming into direct contact with the rolling surfaces 133, whereby it is possible to reduce the mutual contact area compared to the case of coming into direct contact with the rolling surfaces 133. Accordingly, the present invention further reduces the mutual contact area between the rolling surfaces 133 of the contact portion 132 and the plurality of slide balls 150, such that a frictional force occurring between the plurality of slide balls 150 and the rolling surfaces 133 when the movable rail 120 slides relative to the inner rail 130 and the inner rail 130 slides relative to the fixed rail 110 is reduced, thereby allowing the movable rail 120 to smoothly slide.

Figure 10:
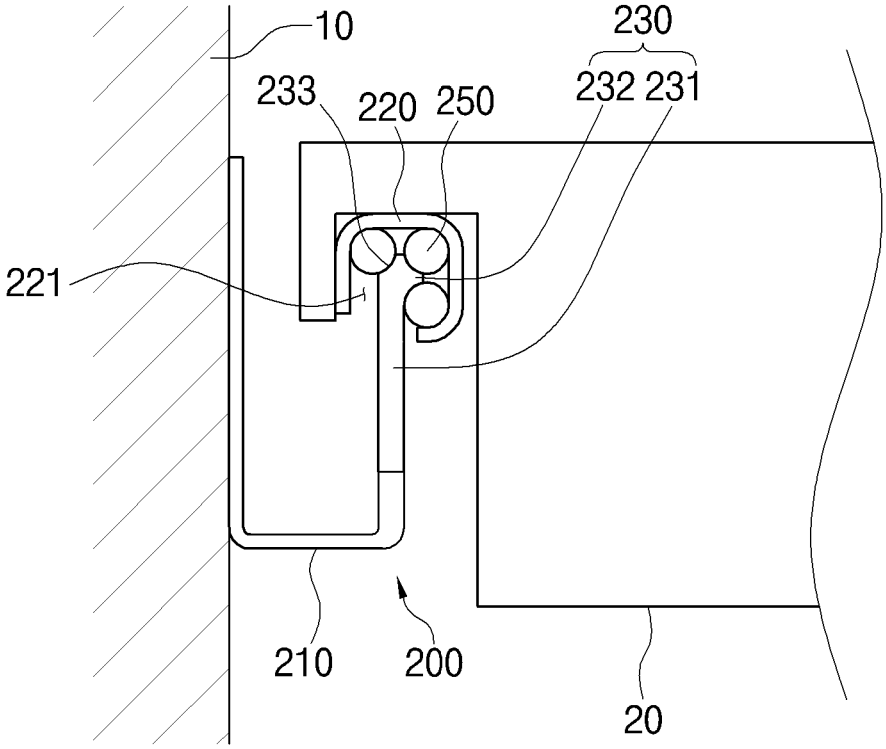
FIG. 10 is a view showing a state where a slide unit for a drawer according to a second embodiment of the present invention is installed.
Figure 11A:
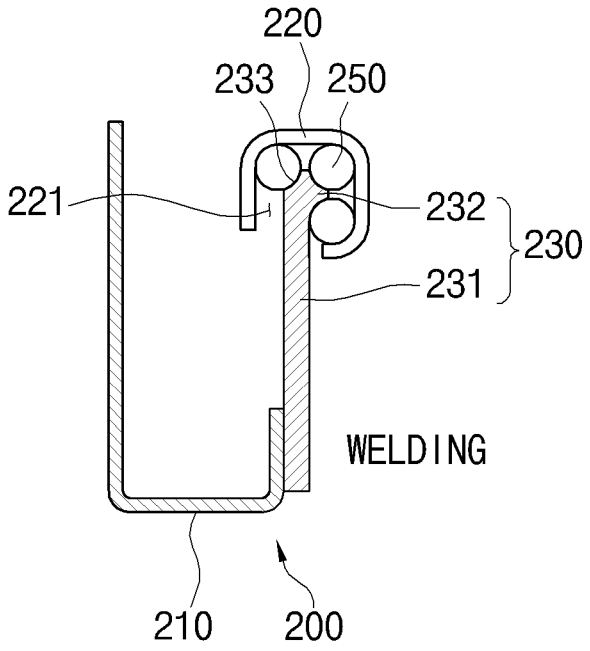
FIGS. 11A and 11B are views showing how a fixed rail and an inner rail are coupled to each other in the slide unit for a drawer according to the second embodiment of the present invention.
Figure 11B:
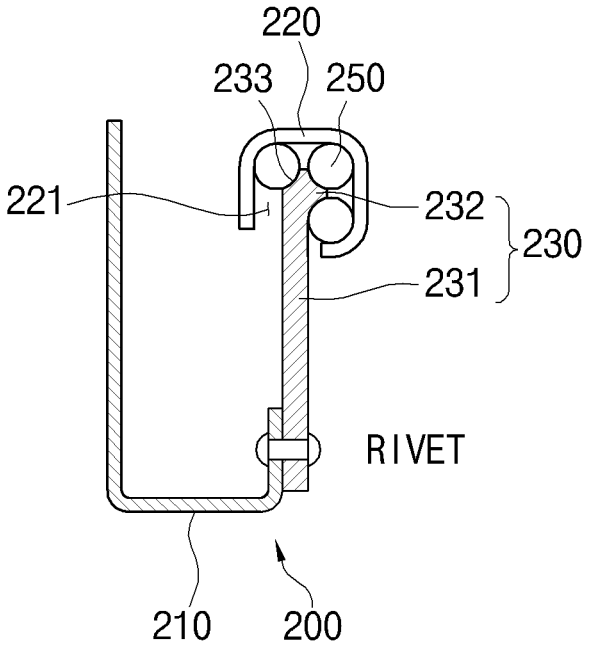

FIG. 10 is a view showing a state where a slide unit for a drawer according to a second embodiment of the present invention is installed; and FIGS. 11A and 11B are views showing how a fixed rail and an inner rail are coupled to each other in the slide unit for a drawer according to the second embodiment of the present invention.

Hereinbelow, reference will be made to the slide unit according to the second embodiment of the present invention, a repetitive description of the same configuration as the first embodiment is omitted, and reference numerals starting with '200' are used for the same configuration.

As shown in FIG. 10, a slide unit 200 according to the second embodiment of the present invention includes: a fixed rail 210 fixed to the main body 10; a movable rail 220 configured to be movable relative to the fixed rail 210 while being connected to the drawer body 20 to allow the drawer body 20 to be pulled out from and pushed into the main body 10, and provided with an inner accommodation space 221; and inner rail 230 connected to an end portion of the fixed rail 210 to be disposed in the inner accommodation space 221 of the movable rail 220, and configured to allow the movable rail 220 to slide relative to the fixed rail 210. Herein, the inner rail 230 is formed by rolling as in the first embodiment.

In the first embodiment of the present invention, the inner accommodation space 111 is provided at an end portion of a side of the fixed rail 110. On the contrary, in the second embodiment of the present invention, the fixed rail 210 is formed to have an approximately 'U' shaped cross section, and the end portion is provided to face a direction toward the inner accommodation space 221 of the movable rail 220.

Further, in the second embodiment of the present invention, the inner rail 230 allows the movable rail 220 to slide by coming into contact with a plurality of slide balls 250 disposed in the inner accommodation space 221 of the movable rail 220 while being connected to the end portion of the fixed rail 210.

In other words, in the first embodiment of the present invention, slide movement is performed between the fixed rail 110 and the inner rail 130 and between the inner rail 130 and the movable rail 120, and on the contrary, in the second embodiment of the present invention, slide movement is performed only between inner rail 230 and the movable rail 220.

Herein, the inner rail 230 can be applied in the same manner as the first embodiment in shape and structure except that the contact portion 232 is integrally connected to only one end of the plate 231.

In the second embodiment of the present invention, for one example, as shown in FIG. 11A, the inner rail 230 may be integrally provided at the end portion of the fixed rail 210 by wielding.

Further, for another example, as shown in FIG. 11B, the inner rail 230 may be lockingly connected to the end portion of the fixed rail 210 by rivet joint. Alternatively, the inner rail 230 may be connected to the end portion of the fixed rail 210 by screw-coupling.

As described above, since the slide unit 200 according to the second embodiment of the present invention is configured such that the structure of the fixed rail 210 is simplified and the slide contact is performed only between the inner rail 230 and the movable rail 220, it is possible to further reduce the mutual slide contact area, such that a frictional force occurring when slide movement is performed is reduced, thereby allowing the movable rail 120 to smoothly slide.

Figure 12:
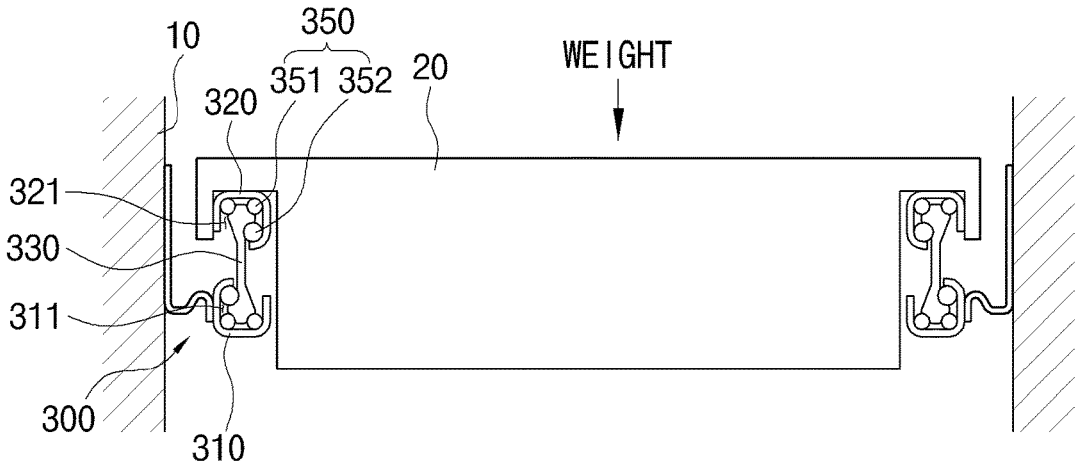
FIG. 12 is a view showing a state where a slide unit for a drawer according to a third embodiment of the present invention is installed.
Figure 13:
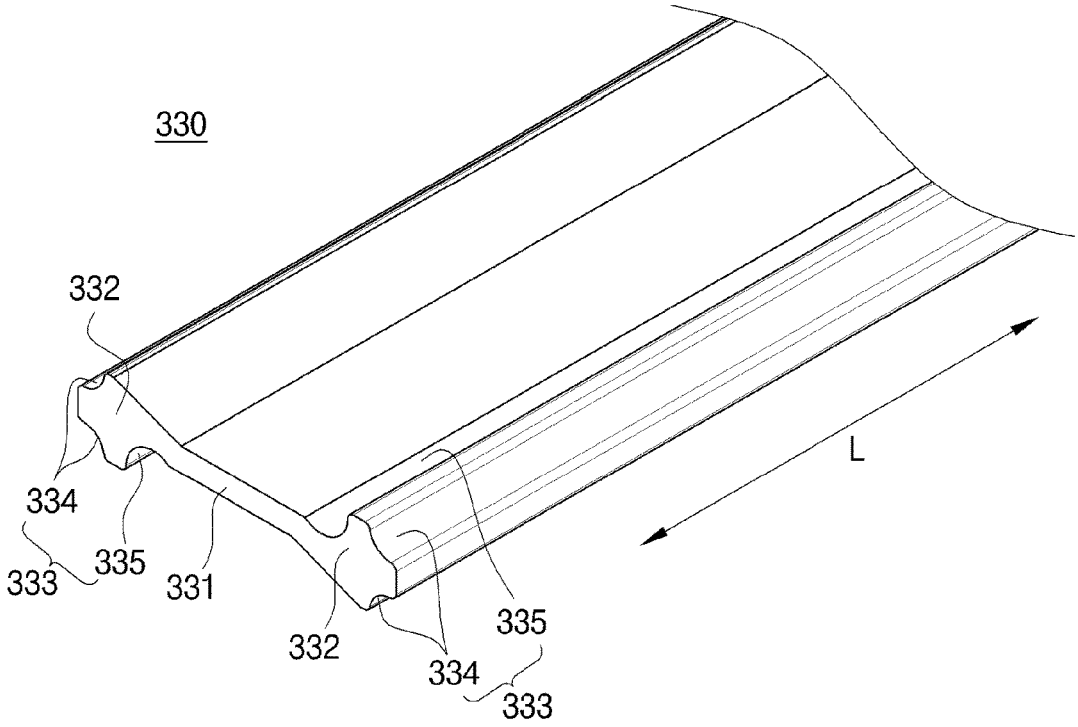
FIG. 13 is a perspective view showing an inner rail of FIG. 12.
Figure 14:
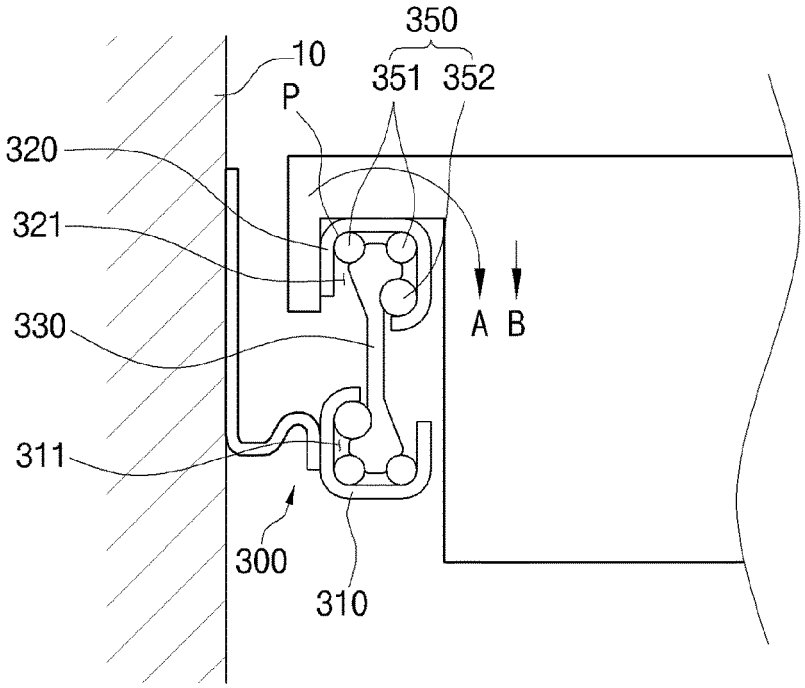
FIGS. 14 and 15 are views showing a state where another example is applied to a fixed rail of FIG. 12.
Figure 15:
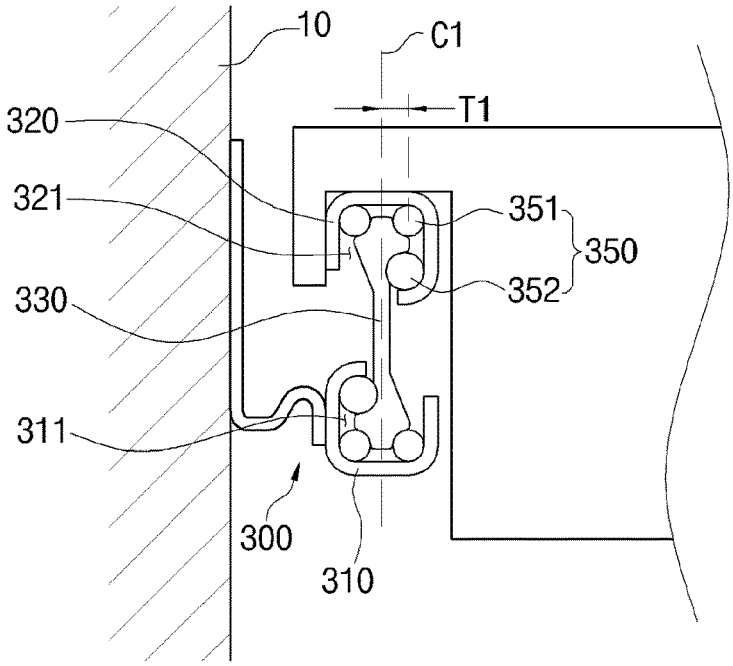

FIG. 12 is a view showing a state where a slide unit for a drawer according to a third embodiment of the present invention is installed; FIG. 13 is a perspective view showing an inner rail of FIG. 12; and FIGS. 14 and 15 are views showing a state where another example is applied to a fixed rail of FIG. 12.

In the third embodiment of the present invention, the slide unit for a drawer is characterized in that through a number of experiments, numerical ranges for the details of the inner rail are found, the durability of the inner rail manufactured based on these numerical ranges is further improved and the rollability is improved.

Hereinbelow, reference will be made to the slide unit according to the third embodiment of the present invention with reference to FIG. 12, a repetitive description of the same configuration as the first embodiment is omitted, and reference numerals starting with '300' are used for the same configuration.

As shown in FIG. 12, a slide unit 300 according to the third embodiment of the present invention includes a fixed rail 310 fixed to the main body 10 and provided with an inner accommodation space 311 at a side thereof; a movable rail 320 configured to be movable relative to the fixed rail 310 while being connected to the drawer body 20 to allow the drawer body to be pulled out from and pushed into the main body 10, and provided with an inner accommodation space 321; and an inner rail 330 configured such that at least a portion thereof is provided in the inner accommodation spaces 311 and 321 of both the fixed rail 310 and the movable rail 320 to allow the movable rail 320 to slide relative to the fixed rail 310. Herein, the inner rail 230 is formed by rolling as in the first embodiment.

The third embodiment differs from the first and second embodiments in the shape of the inner rail, and in the configuration of the rolling surfaces and the slide balls. Due to this difference, even though a heavy load is applied to the slide unit 300 when the drawer body 20 contains a heavy object, the slide unit 300 can be smoothly moved, and durability can be improved.

To be more specific, as shown in FIG. 13, the inner rail 330 is configured such that at least a portion thereof is provided in the inner accommodation spaces 311 and 321, and it allows the movable rail 320 to slide relative to the fixed rail 310 by the rolling friction of the slide balls 350, wherein the inner rail 330 includes: a plate 331 provided at outer areas of both the fixed rail 310 and the movable rail 320; and a contact portion 332 integrally extending from each of opposite ends of the plate 331 and being configured to come into rolling contact with each of a plurality of slide balls 150 accommodated in the inner accommodation spaces 311 and 321.

Further, the contact portion 332 is provided at upper and lower ends with three rolling surfaces 333 spaced apart from each other along a circumferential direction thereof, and the rolling surfaces 333 extend along a longitudinal direction of the contact portion 332. In this case, the rolling surfaces 333 include: a pair of first rolling surfaces 334 curvedly provided at opposite sides of an upper portion of the contact portion 332 with a pair of first slide balls 351 seated thereon; and a second rolling surface 335 having a diameter larger than a diameter of each of the first rolling surfaces 334, and being provided to be curved in a direction toward the drawer body 20 under the first rolling surfaces 334 with a second slide ball 352 rolling thereon.

In this case, referring again to FIG. 12, based on the cross sections of the fixed rail 310 and the movable rail 320, three slide balls 350 are provided in the inner accommodation spaces 311 and 321, respectively, and the slide balls 350 may include: first slide balls 351 coming into contact with the first rolling surfaces 334; and a second slide ball 352 having a diameter greater than that of each of the first slide balls 351 and coming into contact with the second rolling surface 335.

Each of the first slide balls 351 is formed to have a diameter smaller than that of each of the first rolling surfaces 334, and the second slide ball 352 is formed to have a diameter smaller than that of the second rolling surface 335. If each of the slide balls 350 has the same diameter as the diameter of each of the rolling surfaces 333, the frictional force is increased due to the large contact area during rolling motion, and smooth sliding cannot be expected. Thus, The diameter of each of the slide balls 350 can be adjusted within an appropriate numerical range to be smaller than the diameter of the corresponding rolling surface 333.

Meanwhile, as shown in FIG. 14, when a heavy object is stored in the drawer body 20, a clockwise torque A and a load B of the stored object are simultaneously transmitted to the slide unit 300, and here, the torque A and the load B have a greater effect on the movable rail 320, which has many sliding movements, than on the fixed rail 310 fixed to the main body 10.

In this case, the load B is uniformly distributed in the pair of first slide balls 351 to apply pressure thereto, and the torque A presses the second slide ball 352 about a contact point P of the first slide balls 351 and the movable rail 320. The larger the load of the stored object, the higher the pressure applied to the second slide ball 352 compared to the pressure applied to the first slide balls 351. Accordingly, if the torque A is not uniformly distributed, the second slide ball 352 may wear out or become damaged, and thereby, the durability of the entire movable rail 320 may be significantly deteriorated.

Accordingly, the second slide ball 352 and the second rolling surface 335 are formed to have diameters greater than those of the first slide balls 351 and the first rolling surfaces 334, such that the rolling contact area of the second slide ball 352 is increased, thereby uniformly absorbing the pressure due to the torque A. In particular, the uniform absorption of the torque A is performed efficiently when the movable rail 320 slides.

Further, the pair of first slide balls 351 have the same diameter, whereby a uniform load distribution can be achieved for the static load B when the movable rail 320 is not moving.

In this case, as shown in FIG. 15, it is preferred that a distance T1 to each of the first slide balls 351 based on a longitudinal center line C1 of the inner rail 330 be equal to or longer than a radius of the second slide ball 352, and as described above, the radius of the second slide ball 352 be equal to or longer than that of each of the first slide balls 351.

To be more specific, when the radius of the first slide ball 351 is defined as R1, the radius of the second slide ball 352 is defined as R2, and the distance of the first slide ball 351 based on the longitudinal center line C1 of the inner rail 330 is defined as T1, the following inequality relation is established: $R1 \leq R2 \leq T1$.

In this case, $R2 \leq T1$ is set, but if the radius R2 of the second slide ball 352 is set larger than the distance T1, the center of the second slide ball 352 is eccentrically biased to the inner side of the inner rail 330, so that it becomes vulnerable to the torque A and the static load B. Whereby, the durability of the movable rail 320 may be significantly deteriorated or the second slide ball 352 may be separated.

Figure 16:
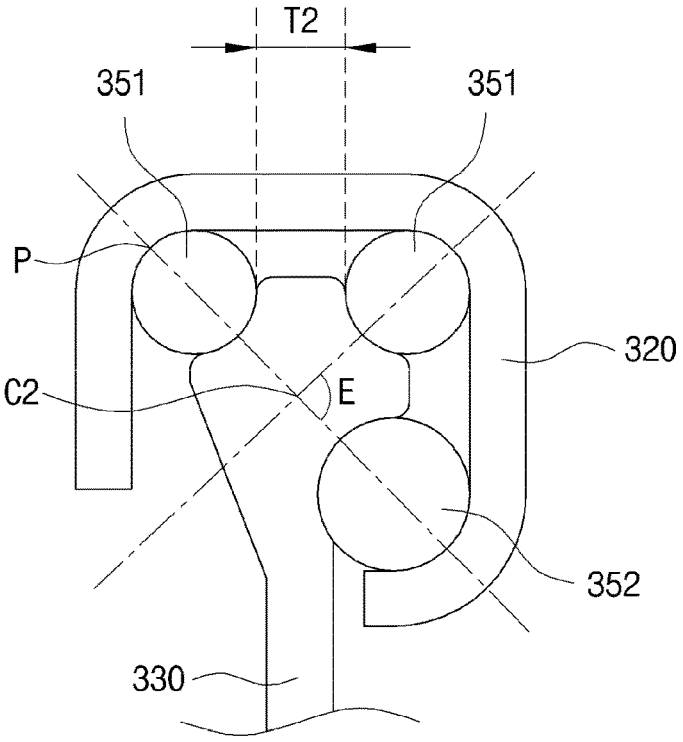
FIG. 16 is a view showing a state where one example is applied to a movable rail of FIG. 12.

As shown in FIG. 16, in the inner rail 330, when a point equally distant from centers of the three slide balls 350 is defined as a center point C2, it is preferred that an included angle E between the second slide ball 352 and a first slide ball 351 close to the second slide ball 352 from the center point C2 be 90° or more.

Further, it is preferred that the included angle E be equal to or less than an angle at which the pair of first slide balls 351 fail to come into contact with each other. To be more specific, the included angle E is set to an angle more than an angle at which a distance T2 between the first slide balls 351 is 0.

Figure 17:
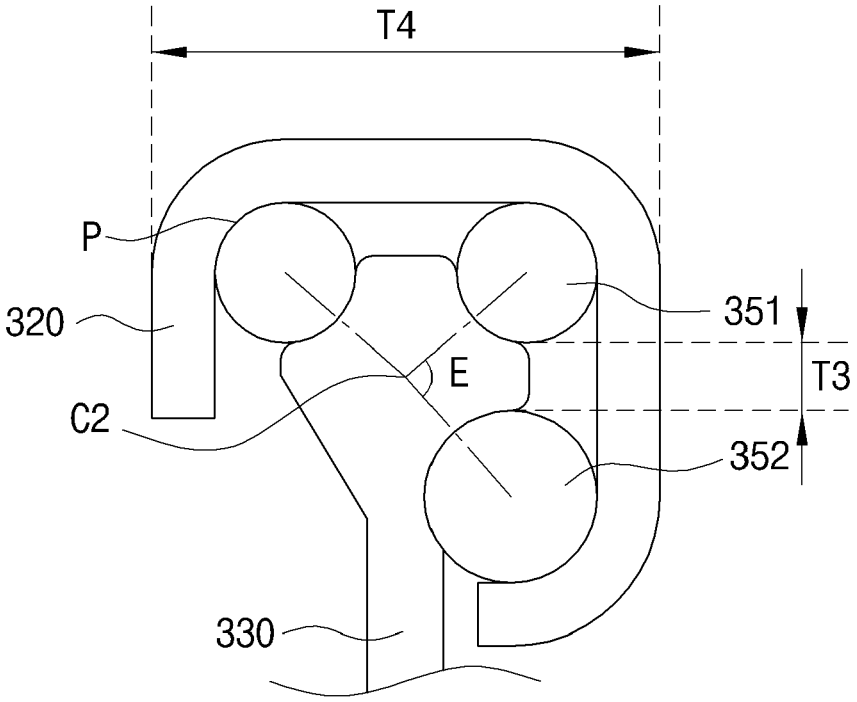
FIG. 17 is a view showing a state where another example is applied to the movable rail of FIG. 12.

In this case, as shown in FIG. 17, if the included angle E is set to a value of 90° or less, a distance T3 between lower ends of the first slide balls 351 and the upper end of the second slide ball 352 is decreased, and a width T4 of the movable rail 320 is increased compared to the distance T3. Whereby, the movable rail 320 has a reduced area to withstand the torque A, and accordingly, a rapid wear of the slide balls 350 occurs, resulting in reduced durability.

Figure 18A:
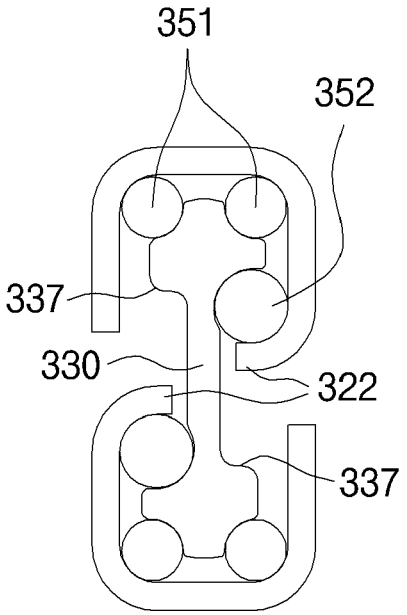
Figure 18B:
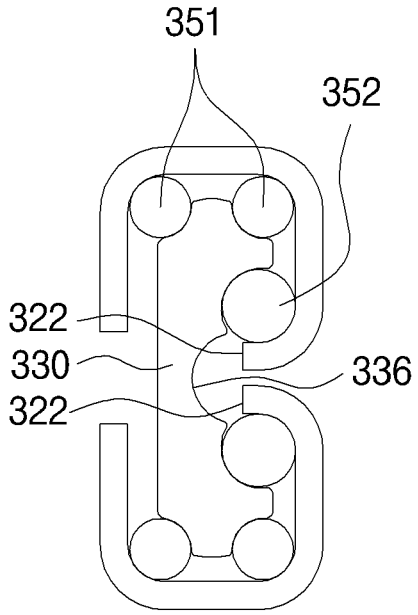
Figure 18C:
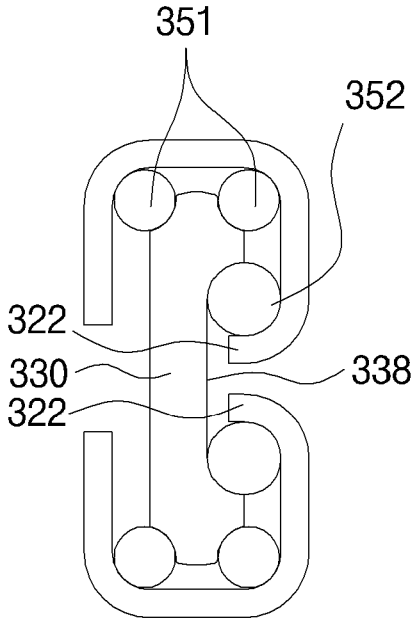

FIGS. 18A, 18B, and 18C are perspective views showing various modifications of the inner rail 330 in the slide unit 300 provided with the first slide balls 351, and the second slide ball 352 having a diameter greater than that of each of the first slide balls 351.

The inner rail 330 shown in FIG. 18A is configured such that a thickness of an end portion 337 without the slide balls 350 is gradually increased. To be more specific, the inner rail 330 shown in FIG. 17 is configured such that an end portion without the slide balls 350 is formed to be in a diagonal shape, and on the contrary, the end portion 337 having a predetermined thickness protrudes in a quadrangular shaped. Whereby, the durability of the inner rail 330 can be improved and the weight of the inner rail 330 can be reduced.

The inner rail 330 shown in FIGS. 18B and 18C is a modification of the inner rail shown in FIG. 2, wherein an upper portion and a lower portion thereof have a symmetrical shape.

In this case, as shown in FIG. 18B, in the plate 331 of the inner rail 330, a semicircular concave surface 336 is formed between the second slide balls 352 provided upper and lower portions, respectively.

Further, since an end portion 322 of the movable rail 320 is bent to surround the second slide ball 352 while coming into contact therewith, it is possible to prevent the second slide ball 352 from being separated from the movable rail, and the end portion 322 can be prevented from coming into contact with the inner rail 330 even if the clockwise torque A (see FIG. 14) is transmitted by drawer body 20 with the heavy object stored therein.

Further, thanks to the concave surface 336, it is possible to reduce the weight of the inner rail 330.

The inner rail 330 shown in FIG. 18C is formed with a sliding surface 338, not the concave surface 336. The sliding surface 338 is formed parallel to the second slide balls 352 provided at the upper and lower portions. In this case, as described above, the separation of the second slide balls 352 is prevented by the end portion 322 of the movable rail 320, and the end portion 322 of the movable rail 320 is prevented from coming into contact with the inner rail 330. Further, a simple configuration of the inner rail 330 makes it easy to manufacture and assemble.

Figure 19A:
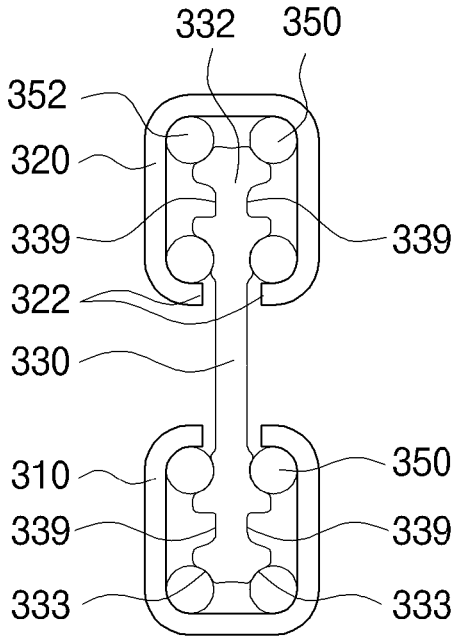
FIGS. 19A and 19B are views showing modifications of the inner rail shown in FIG. 4.
Figure 19B:
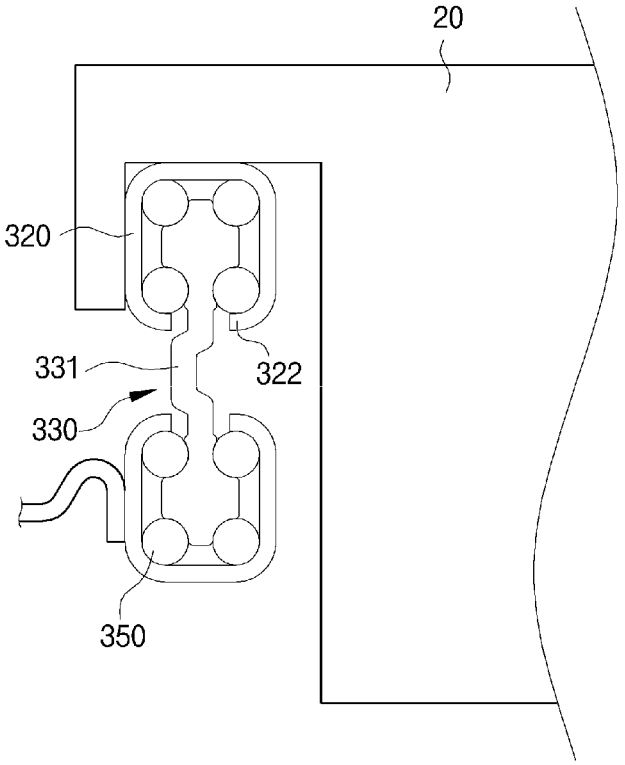

FIGS. 19A and 19B are views showing modifications of the inner rail shown in FIG. 4.

In FIG. 19A, the inner rail 330 is configured such that an upper portion and a lower portion thereof have a symmetrical shape, and the contact portion 332 that is provided to come into rolling contact with each of four slide balls 350 is formed with a concave portion 339 between the slide balls 350, which reduces the weight of the inner rail 330.

Further, the end portion 322 of the movable rail 320 is bent to prevent the slide balls 350 from being separated therefrom.

Further, in FIG. 19B, the inner rail 330 is bent so that the plate 331 has an elastic force in the direction opposite to the drawer body 20.

Whereby, the end portion 322 of the movable rail 320 is not brought into contact with the inner rail 330 by the load of the drawer body 20, and the bent shape of the plate 331 can increase durability by resisting the torque A and the load B of the stored object applied to the slide unit 300.

To be more specific, in the case where the deformation of the inner rail 330 occurs by the load of the drawer body 20 when the heavy load is transmitted to the inner rail 330 due to the heavy object stored in the drawer body 20, smooth sliding of the drawer body 20 is restricted. Accordingly, when the plate 331 is bent in the direction opposite to the drawer body 20, it is possible to further prevent deformation (such as bending) of the inner rail 330.

Figure 20:
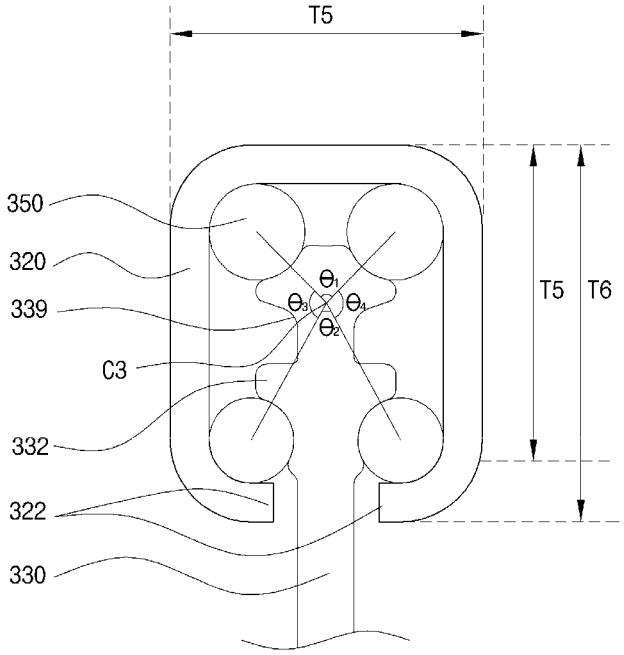
FIG. 20 is a view showing a state where another example is applied to a movable rail of FIG. 19A.

FIG. 20 is a view showing a state where another example is applied to the movable rail of FIGS. 19A and 19B.

As shown in FIG. 20, a lateral width (based on the drawing) of the movable rail 320 provided with the four slide balls 350 is defined as T5, and a longitudinal length thereof is defined as T6. Further, a longitudinal T5 shown in the drawing is the same as the lateral width T5 of the movable rail 320, and is shown for comparison with T6.

Further, when the center point C3 is defined as the center of T5 along a horizontal axis and the center of T5 along a vertical axis of the inner rail 330, and when straight lines with the respective slide balls 350 at the center point C3 are drawn, angles formed on upper and lower sides may be defined as $\theta 1$ and $\theta 2$, respectively, and angles formed on left and right sides may be defined as $\theta 3$ and $\theta 4$, respectively.

In this case, when θ1 is greater than or equal to θ2, and θ3 is equal to θ4, that is, θ1>=θ2 and θ3=θ4, it is possible to minimize deformation (such as bending) of the inner rail 330. In the case of θ3=θ4, height positions of a pair of slide balls 350 provided at the lower portion are the same.

Further, if θ1=θ2 and all the angles are equal, the durability is the strongest by distributing the stress to support the load and torque of the drawer body 20.

Further, it is preferred that a value of T6 be equal to or larger than a value of T5, and equal to or less than twice the value of T5. In this case, as the value of T6 increases, the value of θ2 decreases, and the value of θ4 increases. As the value of θ2 decreases, the length of the inner rail 330 becomes longer, whereby the resistance to the static load may be good, but the resistance to the torque may be weak when the drawer body 20 slides.

Figure 21:
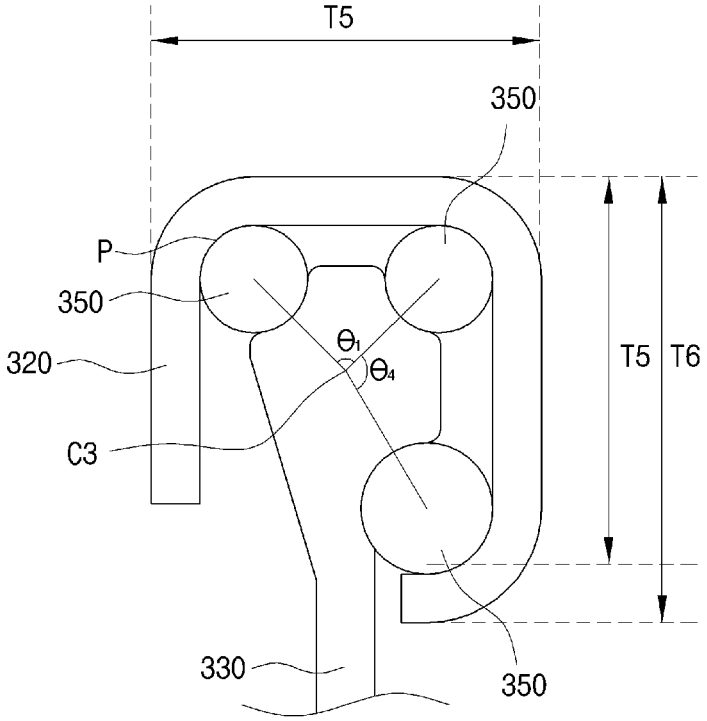
FIG. 21 is a view showing a state where another example is applied to a movable rail of FIG. 12.

FIG. 21 is a view showing a state where another example is applied to a movable rail of FIG. 12.

As shown in FIG. 20, a lateral width (based on the drawing) of the movable rail 320 provided with the three slide balls 350 is defined as T5, and a longitudinal length thereof is defined as T6. Further, a longitudinal T5 shown in the drawing is the same as the lateral width T5 of the movable rail 320, and is shown for comparison with T6.

Further, when the center point C3 is defined as the center of T5 along a horizontal axis and the center of T5 along a vertical axis of the inner rail 330, and when straight lines with the respective slide balls 350 at the center point C3 are drawn, angles formed on upper and lower sides may be defined as θ1, and an angle formed on the right side may be defined as θ4.

As in the FIG. 20, it is preferred that a value of T6 be equal to or larger than a value of T5, and equal to or less than twice the value of T5. In this case, as the value of T6 increases, the value of θ4 increases. As the value of θ4 increases, the length of the inner rail 330 becomes longer, whereby the resistance to the static load may be good, but the resistance to the torque may be weak when the drawer body 20 slides.

As described above, although reference to the embodiments of the slide unit for a drawer has allowed the present invention to be described in more detail, it should be understood that the present invention is not limited to the embodiments but may be variously changed without departing from the technical idea of the present invention. Therefore, the embodiments disclosed in the present invention are not restrictive but are illustrative, and the scope of the technical idea of the present invention is not limited to the embodiments. Accordingly, the scope of the present invention should be interpreted by the accompanying claims. Further, it is to be understood that various alternatives, modifications, and equivalents fall within the spirit and scope of the present invention as defined by the appended claims.

What is claimed is:

1. A slide unit for a drawer, the slide unit comprising:

a fixed rail fixed to a main body and provided with an inner accommodation space at a side thereof;

a movable rail configured to be movable relative to the fixed rail while being connected to a drawer body to allow the drawer body to be pulled out from and pushed into the main body, and provided with an inner accommodation space; and an inner rail configured such that at least a portion thereof is provided in the inner accommodation spaces of both the fixed rail and the movable rail to allow the movable rail to slide relative to the fixed rail, wherein the inner rail is formed by rolling; and the inner rail includes:

a plate; and a contact portion integrally connected to each of opposite ends of the plate, and configured to come into contact with a plurality of slide balls accommodated in the inner accommodation spaces of both the fixed rail and the movable rail, wherein the contact portion includes at least one rolling protrusion provided on each of a plurality of rolling surfaces on the contact portion to be spaced apart from each other, and the rolling protrusion extends along a longitudinal direction of the plate.

2. The slide unit of claim 1, wherein the contact portion is provided with three or four rolling surfaces to be spaced apart from each other along a circumferential direction thereof, and the rolling surfaces extend along a longitudinal direction of the contact portion.

3. The slide unit of claim 1, wherein the plate is provided with a plurality of reinforcing ribs protruding from a surface thereof, the reinforcing ribs configured to extend along a longitudinal direction of the plate and be spaced apart from each other along a width direction of the plate.

4. The slide unit of claim 3, wherein each of the plurality of reinforcing ribs is configured such that a protruding height thereof is smaller than a vertical distance between the surface of the plate with the plurality of reinforcing ribs being connected thereto and an end portion of the contact portion adjacent to the corresponding reinforcing rib.

5. The slide unit of claim 1, wherein the plate is provided with a plurality of through-holes spaced apart from each other along a longitudinal direction thereof.

6. The slide unit of claim 1, wherein the contact portion includes at least one groove provided in each of the plurality of rolling surfaces to be spaced apart from each other, and the groove extends along a longitudinal direction of the plate.

7. The slide unit of claim 1, wherein the fixed rail includes:

a fixed frame fixed to the main body; and an auxiliary frame fixed to the fixed frame and provided with an inner accommodation space at a side thereof.

8. The slide unit of claim 1, wherein the contact portion is provided with three or four rolling surfaces spaced apart from each other along a circumferential direction thereof, and the rolling surfaces include:

a pair of first rolling surfaces curvedly provided at opposite sides of an upper portion of the contact portion with a pair of first slide balls seated thereon; and a second rolling surface having a diameter larger than a diameter of each of the first rolling surfaces, and being provided to be curved in a direction toward the drawer body under the first rolling surfaces with a second slide ball rolling thereon.

9. The slide unit of claim 8, wherein each of the pair of first slide balls has a diameter smaller than the diameter of each of the first rolling surfaces, the second slide ball has a diameter smaller than the diameter of the second rolling surface, the pair of first slide balls have a same diameter, and the second slide ball has a diameter larger than the diameter of each of the first slide balls.

10. The slide unit of claim 8, wherein when a point equally distant from the first slide balls and the second slide ball is defined as a center point, an included angle between the second slide ball and a first slide ball close to the second slide ball from the center point is 90° or more, and equal to or less than an angle at which the pair of first slide balls fail to come into contact with each other.

11. The slide unit of claim 1, wherein the contact portion is provided with four rolling surfaces spaced apart from each other along a circumferential direction thereof, the rolling surfaces curvedly provided at opposite sides of an upper portion and opposite sides of a lower portion of the contact portion, respectively, with four slide balls seated thereon, when a lateral width of the movable rail provided with the four slide balls is defined as T5 and a longitudinal length thereof is defined as T6, a value of T6 is equal to or larger than a value of T5, and equal to or less than twice the value of T5, and when the center point is defined as the center of T5 along a horizontal axis and the center of T5 along a vertical axis of the inner rail, and when straight lines with the respective slide balls at the center point are drawn, angles formed on upper and lower sides are defined as θ1 and θ2, respectively, and angles formed on left and right sides are defined as θ3 and θ4, respectively, θ1 is greater than or equal to θ2, and θ3 is equal to θ4.

12. The slide unit of claim 1, wherein the contact portion is provided with three rolling surfaces spaced apart from each other along a circumferential direction thereof, the rolling surfaces curvedly provided at opposite sides of an upper portion and a side of a lower portion of the contact portion, respectively, with three slide balls seated thereon, and when a lateral width of the movable rail provided with the three slide balls is defined as T5 and a longitudinal length thereof is defined as T6, a value of T6 is equal to or larger than a value of T5, and equal to or less than twice the value of T5.

13. A slide unit for a drawer, the slide unit comprising:

a fixed rail fixed to a main body;

a movable rail configured to be movable relative to the fixed rail while being connected to the drawer body to allow the drawer body to be pulled out from and pushed into the main body, and provided with an inner accommodation space; and an inner rail connected to an end portion of the fixed rail to be disposed in the inner accommodation space of the movable rail, and configured to allow the movable rail to slide relative to the fixed rail, wherein the inner rail is formed by rolling; and the inner rail includes:

a plate; and a contact portion integrally connected to an end of the plate, and configured to come into contact with each of a plurality of slide balls accommodated in the inner accommodation space of the movable rail, wherein the contact portion includes at least one rolling protrusion provided on each of a plurality of rolling surfaces on the contact portion to be spaced apart from each other, and the rolling protrusion extend along a longitudinal direction of the plate.

14. The slide unit of claim 13, wherein the contact portion is provided with three or four rolling surfaces to be spaced apart from each other along a circumferential direction thereof, and the rolling surfaces extend along a longitudinal direction of the contact portion.

15. The slide unit of claim 13, wherein the plate is provided with a plurality of reinforcing ribs protruding from a surface thereof, the reinforcing ribs configured to extend along a longitudinal direction of the plate and be spaced apart from each other along a width direction of the plate.

16. The slide unit of claim 15, wherein each of the plurality of reinforcing ribs is configured such that a protruding height thereof is smaller than a vertical distance between the surface of the plate with the plurality of reinforcing ribs being connected thereto and an end portion of the contact portion adjacent to the corresponding reinforcing rib.

17. The slide unit of claim 13, wherein the plate is provided with a plurality of through-holes spaced apart from each other along a longitudinal direction thereof.

18. The slide unit of claim 13, wherein the contact portion includes at least one groove provided in each of the plurality of rolling surfaces to be spaced apart from each other, and the groove extends along a longitudinal direction of the plate.

19. The slide unit of claim 13, wherein the inner rail is integrally provided in the end portion of the fixed rail.

20. The slide unit of claim 13, wherein the inner rail is lockingly connected to the end portion of the fixed rail.

21. A slide unit for a drawer, the slide unit comprising:

a fixed rail fixed to a main body and provided with an inner accommodation space at a side thereof;

a movable rail configured to be movable relative to the fixed rail while being connected to a drawer body to allow the drawer body to be pulled out from and pushed into the main body, and provided with an inner accommodation space; and an inner rail configured such that at least a portion thereof is provided in the inner accommodation spaces of both the fixed rail and the movable rail to allow the movable rail to slide relative to the fixed rail, wherein the inner rail is formed by rolling; and the inner rail includes:

a plate; and a first contact portion integrally connected to an upper end of the plate and a second contact portion integrally connected to a lower end of the plate, the first and second contact portions configured to come into contact with a plurality of slide balls accommodated in the inner accommodation spaces of both the fixed rail and the movable rail, wherein each of the first and second contact portions is provided with three rolling surfaces to be spaced apart from each other along a circumferential direction thereof, and the rolling surfaces extend along a longitudinal direction of the contact portion, wherein the rolling surfaces of the first contact portions include:

a pair of first rolling surfaces curvedly provided at opposite sides of an upper portion of the contact portion with a pair of first slide balls seated thereon; and a second rolling surface having a diameter larger than a diameter of each of the first rolling surfaces, and being provided to be curved in a direction toward the drawer body under the first rolling surfaces with a second slide ball rolling thereon, wherein the second contact portion with the three rolling surfaces has a symmetrical shape or a mirror shape with respect to the first contact portion with the three rolling surfaces, wherein each of the pair of first slide balls has a diameter smaller than the diameter of each of the first rolling surfaces;

the second slide ball has a diameter smaller than the diameter of the second rolling surface;

the pair of first slide balls have a same diameter; and the second slide ball has a diameter larger than the diameter of each of the first slide balls, wherein a distance to a center of the first slide balls from a longitudinal center line of the inner rail is longer than a radius of the second slide ball; and when a point equally distant from the first slide balls and the second slide ball is defined as a center point, an included angle between the second slide ball and a first slide ball close to the second slide ball from the center point is 90° or more, and equal to or less than an angle at which the pair of first slide balls fail to come into contact with each other.

22. The slide unit of claim 21, wherein the second contact portion with the three rolling surfaces has the symmetrical shape with the first contact portion with the three rolling surfaces.

23. The slide unit of claim 1, wherein the second contact portion with the three rolling surfaces has the mirror shape with respect to the first contact portion with the three rolling surfaces.

* * * * *